US005910197A

United States Patent [19]

Chaconas

[11] Patent Number: 5,910,197

[45] Date of Patent: Jun. 8, 1999

[54] WRENCH WITH SUPPLEMENTARY DRIVING LUGS FORMED ON ITS SQUARE CROSS-SECTIONED DRIVE TANG AND INTERCHANGEABLE SOCKETS THEREFOR

[75] Inventor: Peter Constantine Chaconas, Glyndon, Md.

[73] Assignee: Hand Tool Design Corporation, Wilmington, Del.

[21] Appl. No.: 08/902,934

[22] Filed: Jul. 30, 1997

[51] Int. Cl.[6] ..... B25B 13/00; B25B 23/16; B25B 13/46

[52] U.S. Cl. ..... 81/124.6; 81/177.85; 81/60; 81/63.1; 81/61; 81/62; 81/63; 81/63.2

[58] Field of Search ..... 81/60, 61, 62, 81/63.1, 63.2, 63, 124.6, 177.85, 436, 460, 461; 403/359, 383, 361

[56] References Cited

U.S. PATENT DOCUMENTS

| | | | |
|---|---|---|---|
| D. 168,385 | 12/1952 | Watson . | |
| 877,465 | 1/1908 | Lund . | |
| 1,167,242 | 1/1916 | Wright . | |
| 2,461,680 | 2/1949 | Cousino . | |
| 2,701,494 | 2/1955 | Johnson . | |
| 2,954,994 | 10/1960 | Beers . | |
| 2,956,461 | 10/1960 | Andersen . | |
| 3,073,192 | 1/1963 | Beers . | |
| 3,099,177 | 7/1963 | Kostka . | |
| 3,354,757 | 11/1967 | Grimm et al. . | |
| 3,675,516 | 7/1972 | Knudsen et al. . | |
| 4,126,063 | 11/1978 | Palmer . | |
| 4,189,976 | 2/1980 | Becker . | |
| 4,508,005 | 4/1985 | Herman et al. | 81/177.85 |
| 4,581,957 | 4/1986 | Dossier . | |
| 4,817,475 | 4/1989 | Kelly et al. . | |
| 5,199,330 | 4/1993 | Arnold et al. . | |
| 5,214,987 | 6/1993 | Fenton, Sr. | 81/460 |
| 5,216,941 | 6/1993 | Kolvereid . | |
| 5,481,948 | 1/1996 | Zerkovitz . | |

*Primary Examiner*—David A. Scherbel
*Assistant Examiner*—Philip J. Hoffman
*Attorney, Agent, or Firm*—Leonard Bloom

[57] ABSTRACT

A plurality of circumferentially-spaced driving lugs are formed on the improved square-drive tang of a wrench, such as a ratchet wrench; and these driving lugs cooperate with a corresponding plurality of recesses or pockets formed in the top portion of an improved interchangeable square-drive socket, thereby providing for improved torque transmission which is supplemental to, and not a substitute for, the square drive. The improved wrench is compatible with conventional sockets, and the improved socket is compatible with conventional wrenches.

4 Claims, 10 Drawing Sheets

WRENCH WITH SUPPLEMENTARY DRIVING LUGS FORMED ON ITS SQUARE CROSS-SECTIONED DRIVE TANG AND INTERCHANGEABLE SOCKETS THEREFOR

FIELD OF THE INVENTION

The present invention relates to a hand-operated wrench, such as a ratchet wrench, used in conjunction with a plurality of interchangeable wrench sockets and, more particularly, to a heavy-duty ratchet wrench providing improved torque transmission between the ratchet wrench and the wrench socket and precluding premature failure or inadvertent slippage therebetween.

BACKGROUND OF THE INVENTION

Reversing ratchet wrenches are widely used by automobile mechanics, maintenance personnel and home craftsmen and hobbyists. These ratchet wrenches, such as those shown in U.S. Pat. No. 5,199,330 assigned to the assignee of the present invention, generally comprise a reversing pawl cooperating with a ratchet gear having an integrally-formed square cross-sectioned drive tang provided with a spring-loaded ball detent, and a selected one of a plurality of interchangeable wrench sockets is removably mounted on the drive tang and is resiliently retained thereon by the ball detent.

Under heavy-duty loads incurred during final tightening or initial loosening of a nut (or other fastener) and especially where undue leverage is exerted on the ratchet wrench, slippage in the square drive, as well as premature failure, may occur in the square cross-sectioned drive tang.

In an effort to alleviate this problem and yet provide for heavy-duty torque transmission between the drive tang and the socket, a product currently being market-introduced in Europe consists of a plurality of circumferentially-spaced radially-extending arcuately-formed lobes provided on the bottom or lower portion of an enlarged square cross-sectioned drive tang. These lobes define therebetween a plurality of recesses or pockets which cooperate with driving shoulders or lugs formed down within the driven wrench socket. Thus, these lobes are quite similar to a spline-drive socket such as that shown in the now-expired U.S. Pat. No. 3,073,192 and, in fact, the lobes (or splines) are terminated along the longitudinal axis of the drive tang, that is, they terminate intermediately of the length of the tang. Moreover, the axial length of the tang above the lobes, while being of a substantially square cross-section, has a clearance with respect to the square cross-sectioned hole in the socket. As a result, the torque is transmitted primarily through the arcuate lobes, not the square drive, thus placing heavier loading upon the lobes.

There are several major disadvantages in this construction. First, the lobes are formed out of a substantially enlarged cross-sectioned drive tang. For example, in order to provide a so-called "super" ⅜" drive, the distance between the "bottoms" of the pockets (measured across the cross-section of the tang) is ⅜". This is costly and inefficient. Second, the torque transmission is primarily between the lobes on the drive tang and the pockets in the wrench socket, in effect, a truncated spline drive and not primarily between the square drive itself. Moreover, this drive across the lobes is relatively far removed from the ratchet mechanism in the wrench (measured in a plane perpendicular to the plane or planes of the wrench) and, as a result, undue bending or torsional loads are imposed on the drive tang. Third, the tang itself is specially formed and is usable only with the specially designed sockets; thus conventional sockets cannot be used on the wrench, nor can the specially-designed sockets be used on a conventional wrench.

SUMMARY OF THE INVENTION

Accordingly, it is an object of the present invention to alleviate the deficiencies and disadvantages of the prior art by providing a plurality of circumferentially-spaced radially-projecting driving lugs directly on a conventional square cross-sectioned drive tang.

It is another object of the present invention to position the driving lugs relatively close to the bottom planar surfaces of the ratchet wrench, thereby eliminating undue bending or torsional stresses on the drive tang of the ratchet wrench.

It is a further object of the present invention to provide driving lugs which are supplementary to, not a substitute for, the primary square drive between the tang and the socket.

As a result of these improvements, several major advantages are obtained: first, lower manufacturing costs; second, substantially reduced bending or torsional stresses on the drive tang; and third, the wrench is usable with conventional sockets, as well as with the specially-designed sockets, while the specially-designed sockets are usable with conventional wrenches.

In accordance with the teachings of the present invention, there is provided (in combination) a ratchet wrench including a square cross-sectioned drive tang provided with a plurality of circumferentially-spaced driving lugs, and a wrench socket having a square cross-sectioned opening receiving the drive tang on the ratchet wrench and further having a corresponding plurality of circumferentially-spaced pockets receiving the driving lugs on the drive tang of the ratchet wrench.

This combination facilitates improved torque transmission between the ratchet wrench and the wrench socket, yet the ratchet wrench will accommodate a conventional wrench socket having a square cross-sectioned opening receiving the drive tang on the ratchet wrench, in which case the top of the conventional wrench socket bottoms or abuts against the respective lower portions of the driving lugs on the drive tang of the ratchet wrench.

These and other objects of the present invention will become apparent from a reading of the following specification taken in conjunction with the enclosed drawings.

DESCRIPTION OF THE PREFERRED EMBODIMENTS

Figure 1:
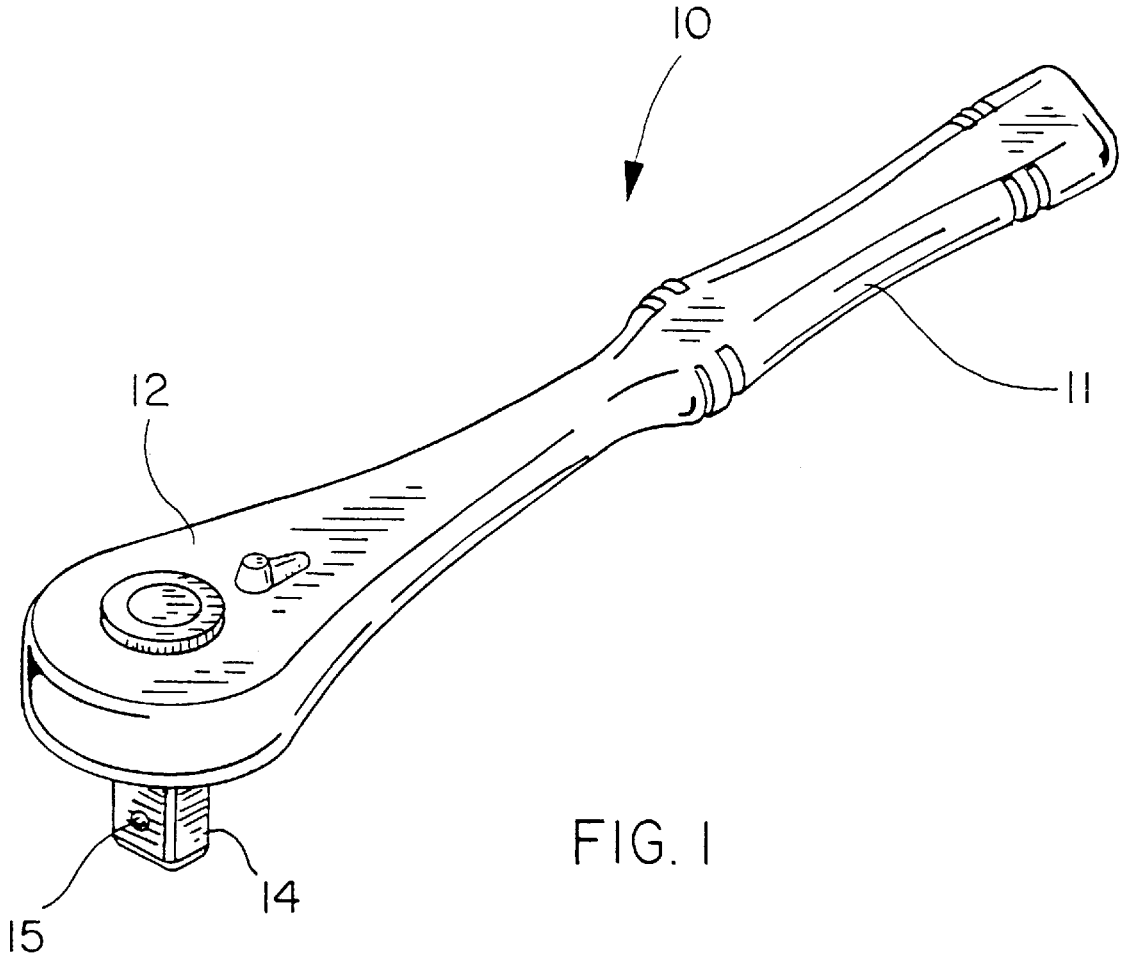
FIG. 1 is a top perspective view of a ratchet wrench with which the teachings of the present invention may find more particular utility.
Figure 2:
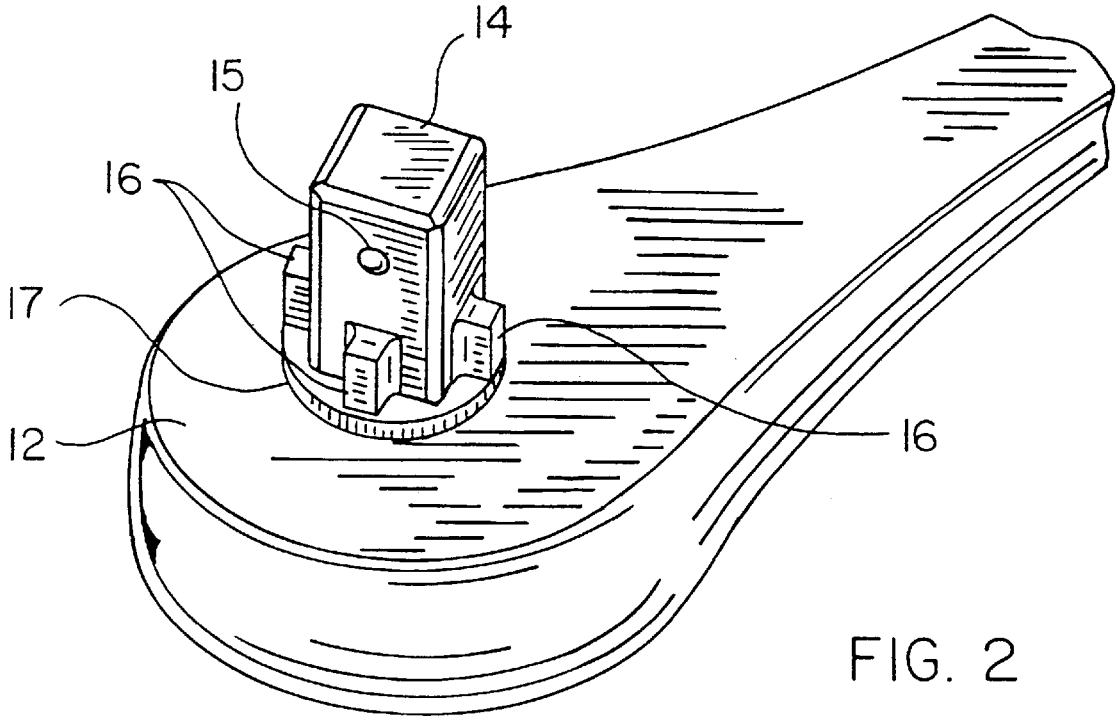
FIG. 2 is a bottom perspective view of the ratchet wrench of FIG. 1 (enlarged in scale and with part of the handle broken away) and showing the improved drive tang of the present invention.
Figure 3A:
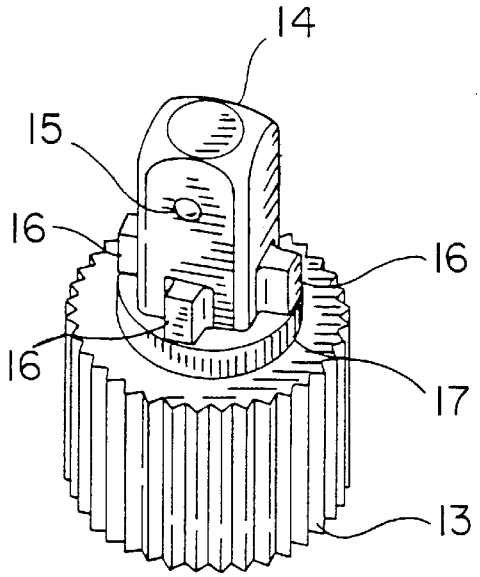
FIG. 3A is a perspective view of the integral drive tang and ratchet gear of the present invention, showing the plurality of circumferentially-spaced driving lugs on the drive tang and further showing a reinforcing collar between the driving lugs and the ratchet gear (the ratchet gear itself being conventional).
Figure 3B:
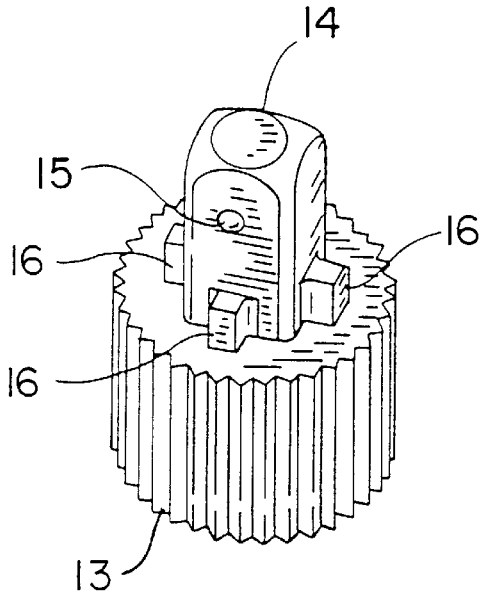
FIG. 3B is another perspective view of the integral drive tang and ratchet gear of the present invention, similar to FIG. 3A, but eliminating the collar.
Figure 4:
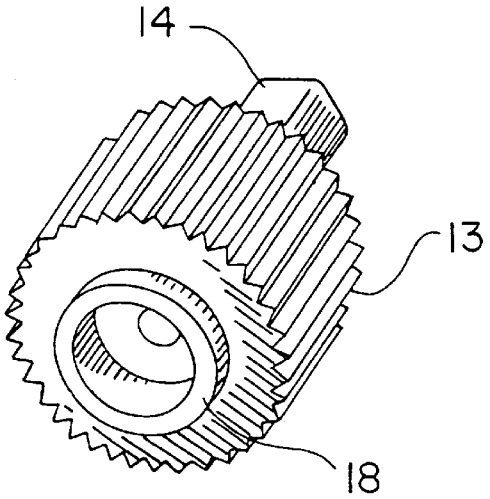
FIG. 4 is a perspective view of the integral drive tang and ratchet gear of the present invention (viewed from its opposite end).
Figure 5:
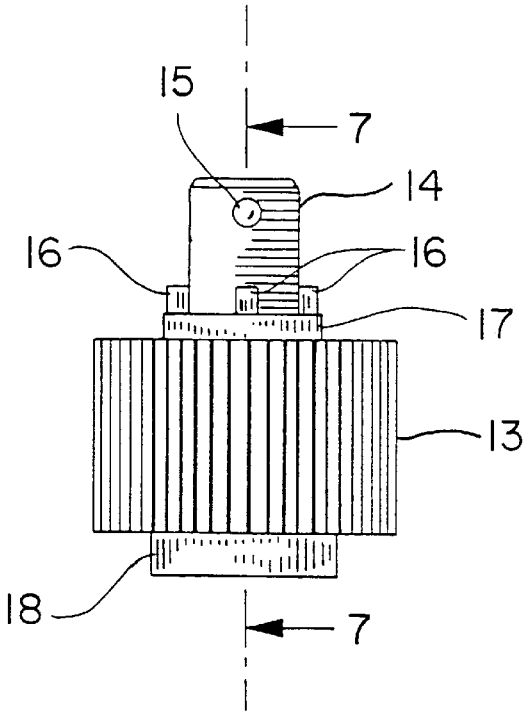
FIG. 5 is an elevational view thereof.
Figure 6:
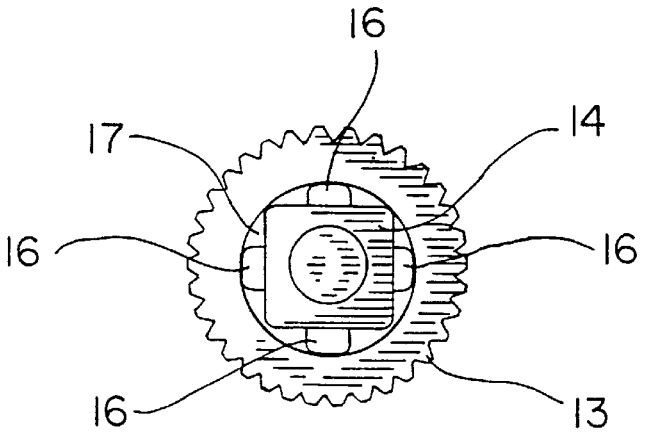
FIG. 6 is a top plan view thereof.
Figure 7:
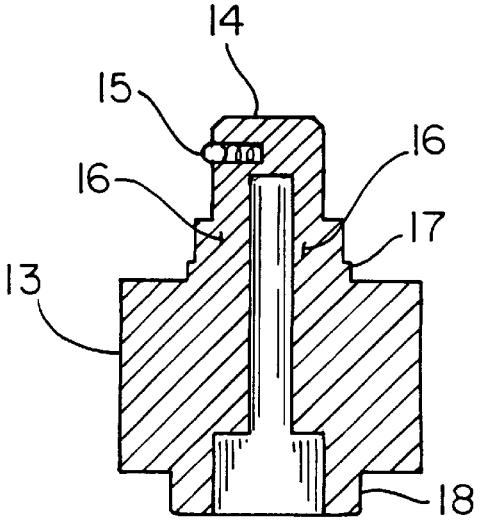
FIG. 7 is a cross sectional view thereof taken along lines 7—7 of FIG. 5.
Figure 8:
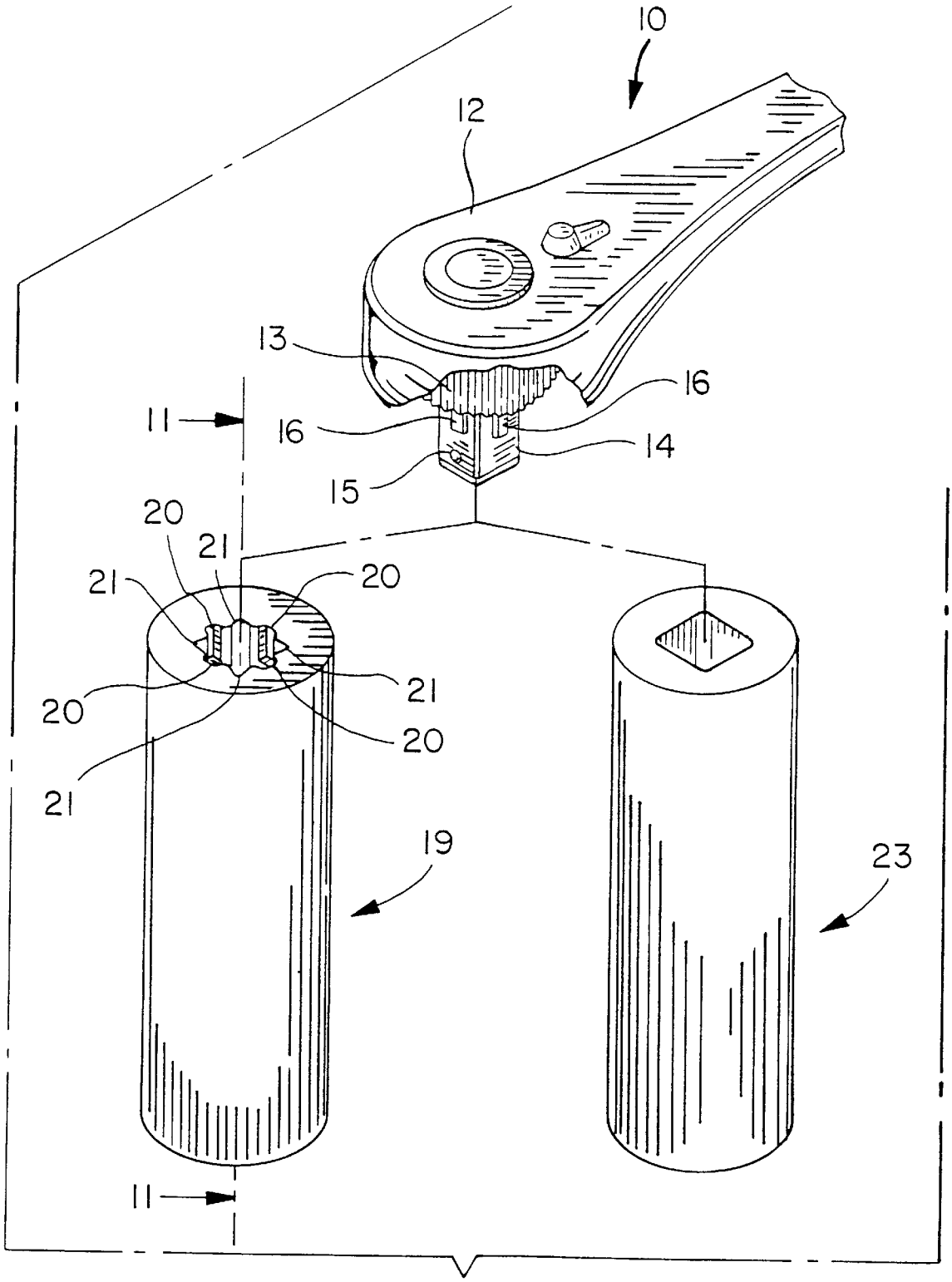
FIG. 8 is an exploded perspective view of the ratchet wrench equipped with the improved drive tang of the present invention and showing, schematically, how the wrench may be used with the specially-designed socket of the present invention or with a conventional wrench socket.
Figure 10:
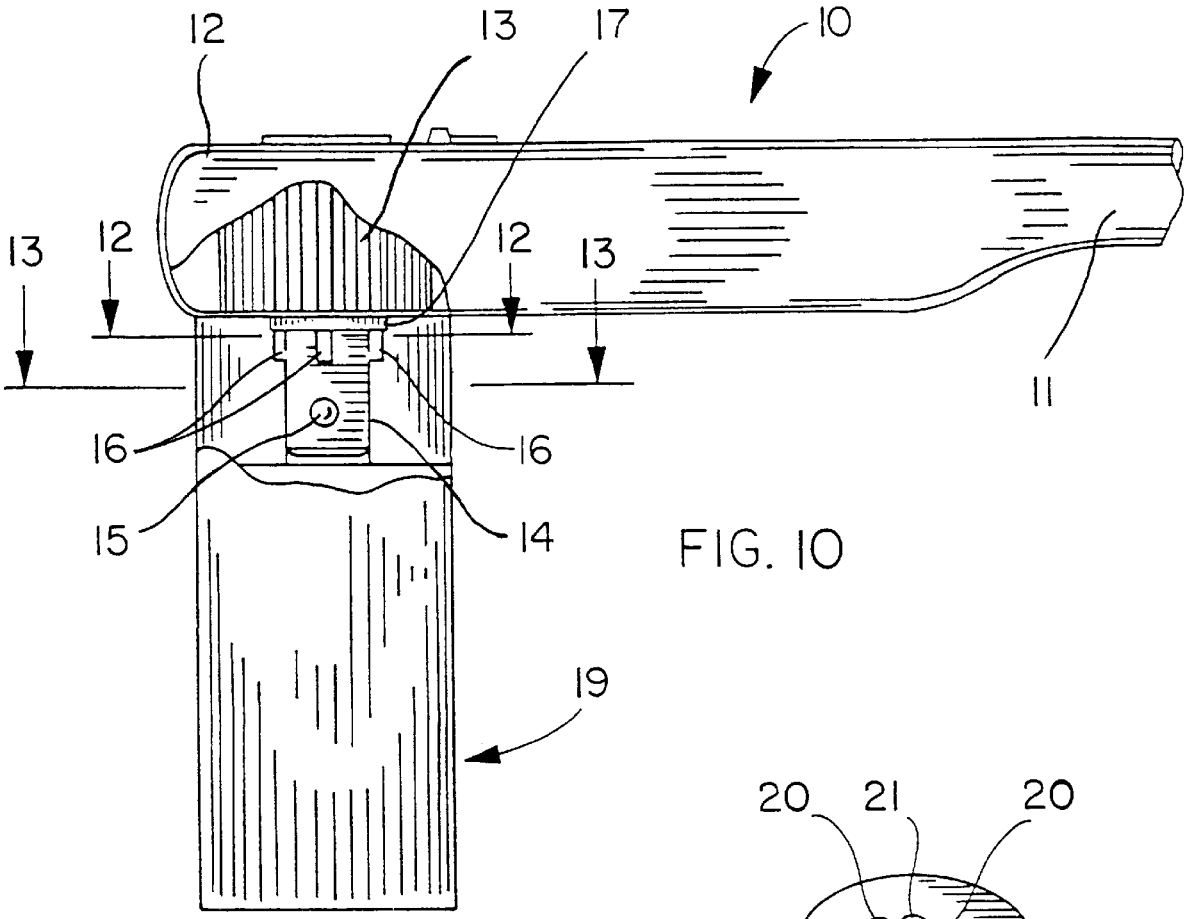
FIG. 10 is a side elevational view, with parts broken away, to show the specially-designed socket mounted on the improved drive tang of the present invention.
Figure 9:
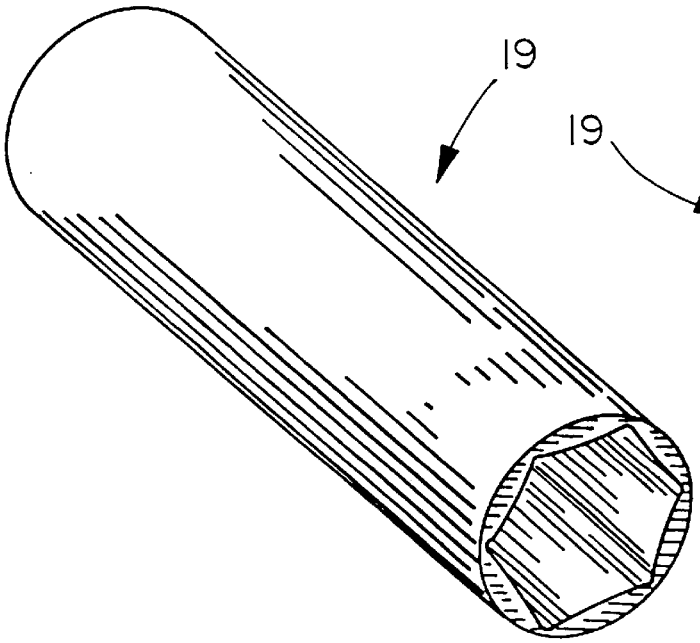
FIG. 9 is a perspective view of the specially-designed socket of the present invention, viewed from the opposite end thereof.
Figure 11:
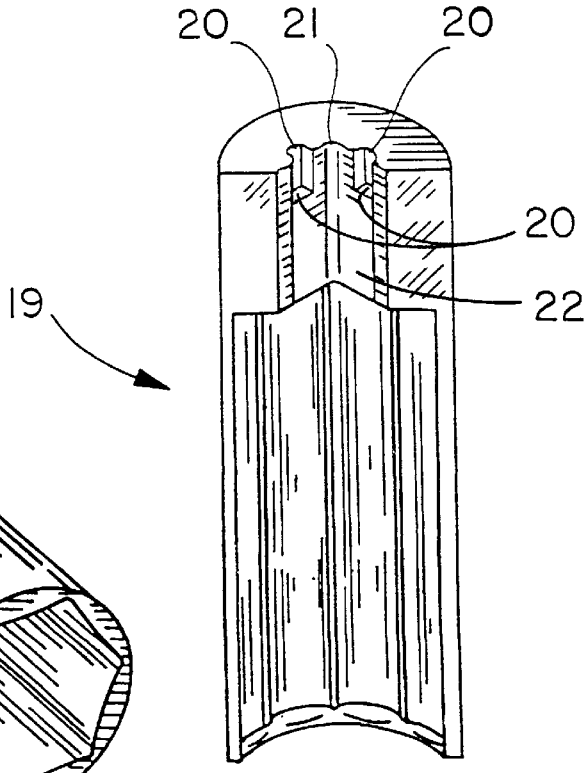
FIG. 11 is a cut-away elevational view of the improved socket of the present invention.
Figure 12:
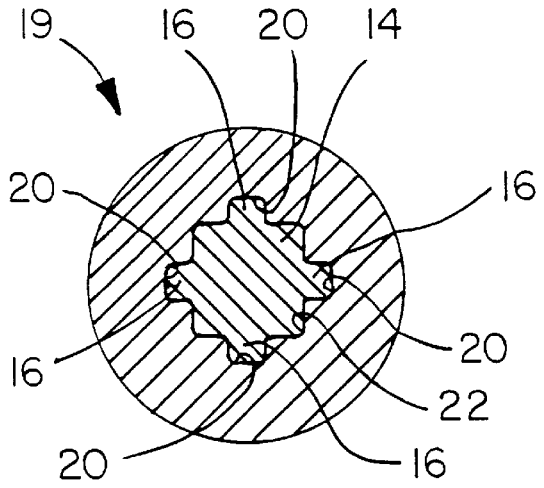
FIG. 12 is a cross-sectional view, taken along the lines 12—12 of FIG. 10.
Figure 13:
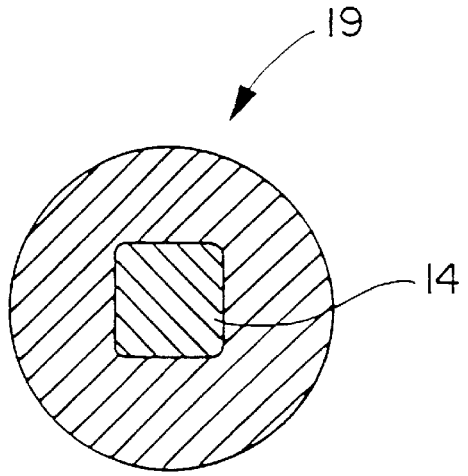
FIG. 13 is a cross-sectional view, taken along the lines 13—13 of FIG. 10.
Figure 14:
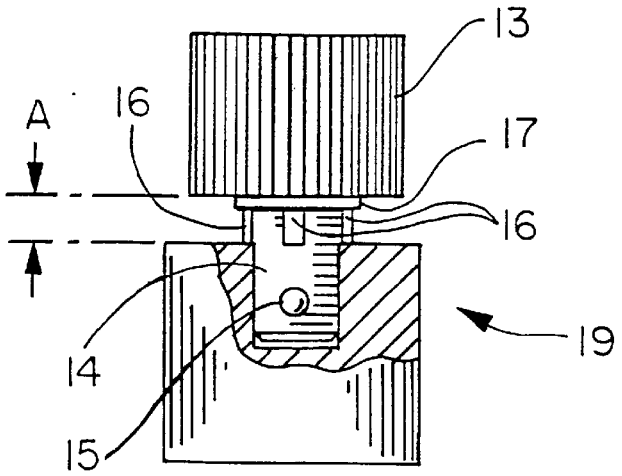
FIG. 14 is an elevational view of the integral drive tang and ratchet gear of the present invention, showing its use with a conventional socket (part of which is broken away for ease of illustration).

With reference to FIG. 1, there is shown a (modified) ratchet wrench 10 with which the teachings of the present invention may find more particular utility. It will be understood by those skilled in the art, however, that the present invention is not necessarily confined thereto but, rather, is applicable to a wide variety of ratchet wrenches and non-ratcheting wrenches (as hereinafter described). With this in mind, the ratchet wrench 10 generally includes a handle 11 and a head 12, and the head 12 includes a ratcheting mechanism including a pawl (not shown).

With reference to FIGS. 2–7, the ratcheting mechanism in the head 12 of the ratchet wrench 10 includes a conventional ratchet gear 13 which is formed integrally with a square cross-sectioned drive tang 14. The drive tang 14 has a conventional spring-loaded ball detent 15 for retaining a selected one of a plurality of interchangeable wrench sockets (hereinafter described in detail).

In accordance with the teachings of the present invention, a plurality of circumferentially-spaced radially-projecting driving lugs 16 are formed on the drive tang 14. In the preferred embodiment of FIG. 3A, a collar 17 is disposed between the driving lugs 16 and the ratchet gear 13; and in the alternate embodiment of FIG. 3B, the collar 17 has been eliminated.

A collar 18 (see FIG. 4) has been formed on the opposite end of the integral, unitary ratchet gear 13 and drive tang 14, but this collar 18 forms no part of the present invention.

With reference to FIGS. 8–14, the driving lugs 16 on the drive tang 14 cooperate with a specially-designed (modified) socket 19 which is part of an array of interchangeable specially-designed sockets (not shown). The socket 19 has a corresponding plurality of circumferentially-spaced pockets 20 (separated therebetween by a plurality of recesses 21) and these pockets 20 receive the driving lugs 16. In this preferred embodiment, the driving lugs 16 and the corresponding pockets 20 are spaced 90° apart (as shown).

As will be appreciated by those skilled in the art, a number of features and advantages are provided by the present invention, as follows:

1) The driving lugs 16 provide a torque transmission between the wrench 10 and the socket 19 which is supplemental to—and not a substitute for—the drive between the square cross-sectioned drive tang 14 and the square-drive opening 22 in the socket 19.

2) Since the supplementary drive through the driving lugs 16 is relatively close to the head portion 12 of the wrench 10 (measured axially of the drive tang 14, that is, vertically in a plane which is perpendicular to the plane or planes of the wrench 10) there is less of a moment-arm effect; that is, the bending or torsional stresses upon the drive tang 14 are substantially reduced.

3) The size of the drive tang 14 is identical to other square-drive ratchet wrenches, and the necessity for a drive tang 14 with a substantially enlarged cross-section is altogether eliminated.

On a standard overload test for a conventional ½ inch drive tang, failure occurred at 407 foot-pounds. Using the same standard overload test for a ½ inch drive tang provided with the driving lugs 16 of the present invention, failure occurred at 720 foot-pounds. This is a very significant improvement; and with further refinements to the present invention, the loading could be double that which is currently available using the conventional drive tangs of the prior art.

With reference again to FIG. 8, and with further reference to FIGS. 15A–15D, another (and significant) feature and advantage of the present invention is its ability to accommodate conventional wrench sockets (besides the improved sockets 19 of the present invention).

Figure 15A:
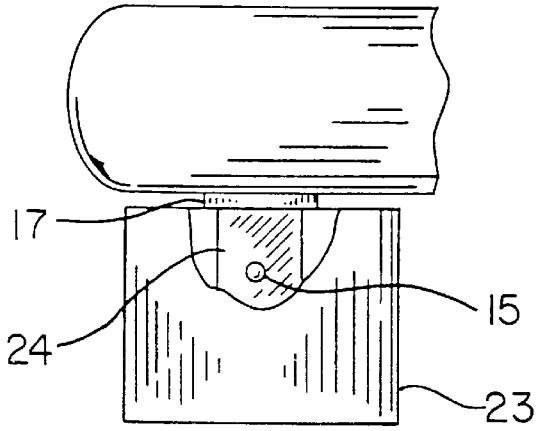
FIG. 15A PRIOR ART
FIG. 15A shows, schematically, the prior art consisting of a conventional wrench socket mounted on a conventional ratchet wrench.

FIG. 15A shows a conventional wrench socket 23 on a conventional drive tang 24 (which is well known in the prior art).

Figure 15B:
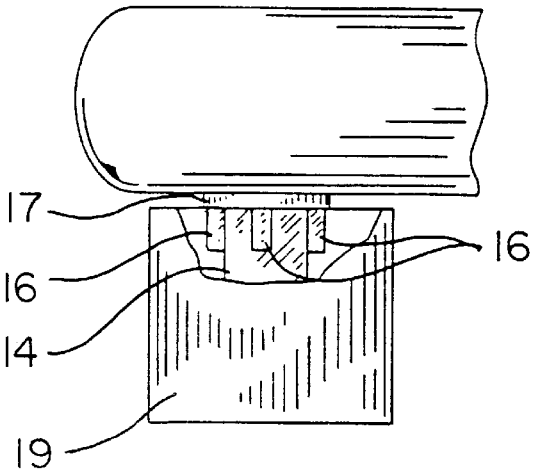
FIG. 15B shows, schematically, a wrench with the improved tang of the present invention inserted into the improved socket thereof.

FIG. 15B shows the improved wrench socket 19 of the present invention on the improved drive tang 14 thereof.

Figure 15C:
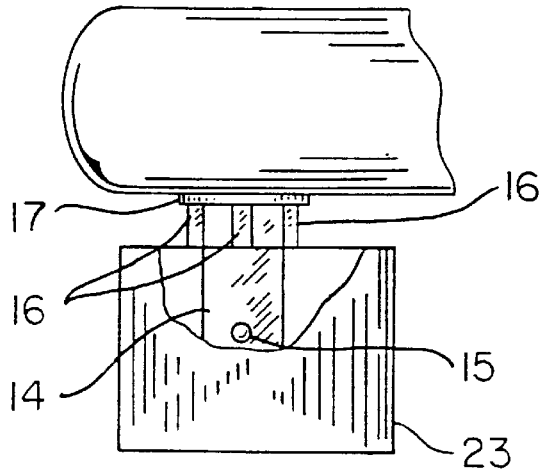
FIG. 15C shows, schematically, the improved tang of the present invention inserted into a conventional prior art socket.

FIG. 15C shows the conventional wrench socket 23 mounted on the improved drive tang 14 of the present invention, wherein the top portion 25 of the wrench socket 23 bears against or bottoms against the lower ends of the driving lugs 16.

Figure 15D:
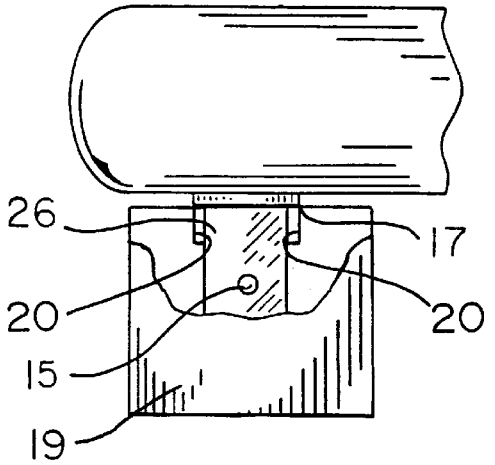
FIG. 15D shows, schematically, a conventional prior art tang inserted into the improved socket of the present invention.

FIG. 15D shows the improved wrench socket 19 of the present invention mounted on the standard drive tang 26 of a conventional ratchet wrench.

Thus, the improved wrench sockets of the present invention are fully compatible with the conventional ratchet (or other) wrenches of the prior art, and the conventional wrench sockets of the prior art are fully compatible with the improved drive tang of the present invention. This is an important advantage, heretofore not available in the prior art.

Figure 16A:
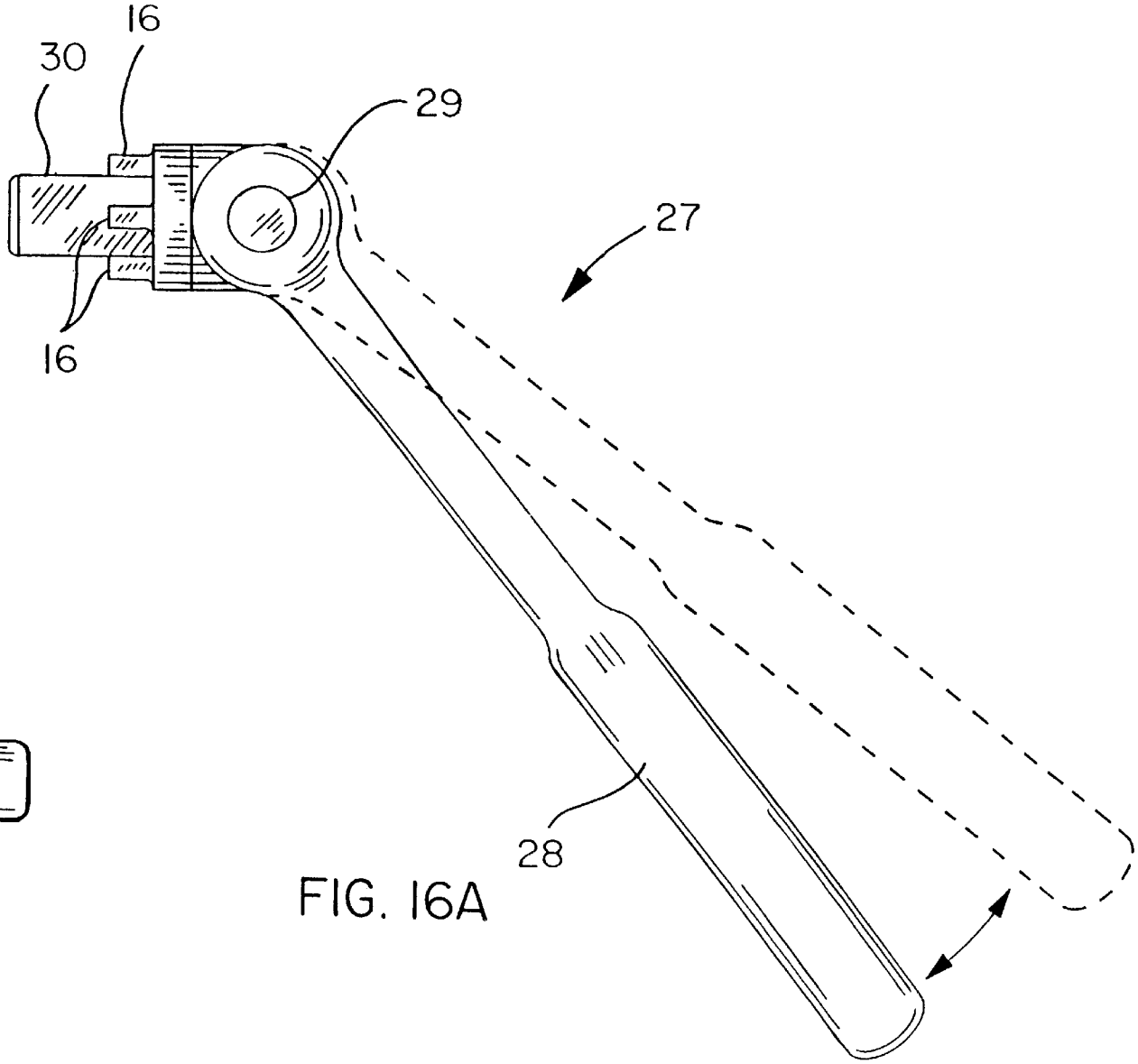
FIG. 16A is a top plan view of the improved drive tang and socket configuration of the present invention, showing its use with a conventional non-ratcheting wrench (which, in this case, is provided with a swivel handle).
Figure 16C:
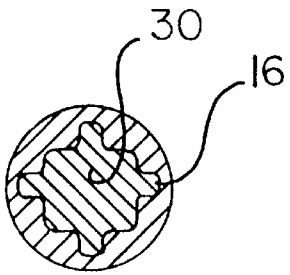
FIG. 16C is a cross-sectional view thereof, taken along the lines 16A–16C of FIG. 16B.
Figure 16B:
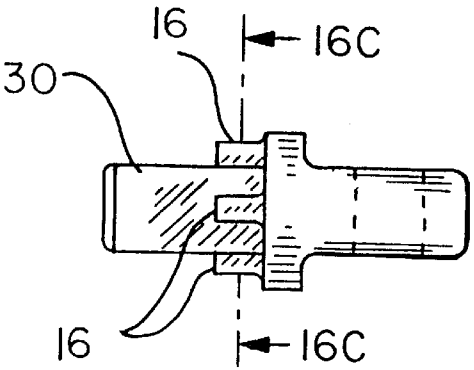
FIG. 16B is an elevational view of the improved drive tang of FIG. 16A (removed from the wrench).
Figure 17:
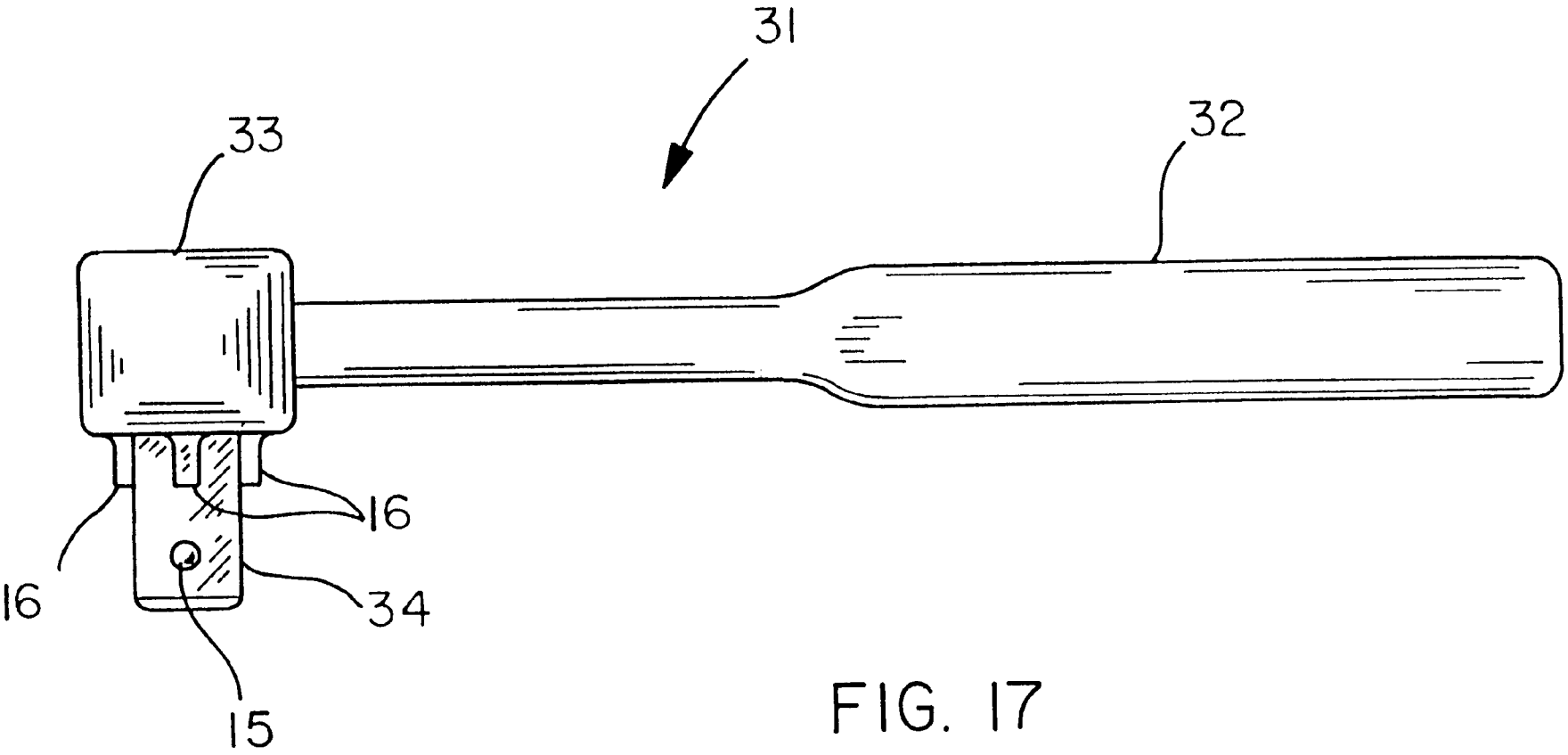
FIG. 17 is a side elevational view of another alternative embodiment of the present invention showing a non-ratcheting wrench with the improved drive tang of the present invention (the head of the wrench being integral with the handle).

Moreover, and as previously noted, the teachings of the present invention are not confined to the conjoint use of a ratchet wrench. As shown in FIGS. 16A–16C, a wrench 27 may have a swivel handle 28 with a pivot 29 and a drive tang 30 equipped with the driving lugs 16 of the present invention. Further, and as shown in FIG. 17, a non-swivel wrench 31 has a handle 32, a head 33 and a drive tang 34 provided with the driving lugs 16 of the present invention.

With reference again to FIG. 14, the addition of the drive lugs 16 of the present invention removes the portions of the collar 17 from being proximate to the square drive's corners in the area subject to mechanical shear by the upper surface edges of the square drive recess of socket 19, that is, the stress risers resulting from change in cross section, the torsional shear stresses and bending stresses are thereby reduced in this critical area. The conventional socket 23 (FIG. 14) is positioned axially by abutting the lower surfaces of the driving lugs 16, and thus torsional stresses are applied in the same location on the non-reinforced portion of the square drive. The length of the corner on the modified/reinforced drive tang is lengthened by the height of the driving lugs 16 in the axial direction (denoted by "A" in FIG. 14). This additional corner length without a stress rising change in cross-section provides for additional torsional deflection to prevent failure. This is a desirable feature and will be appreciated by those skilled in the art, as well as tool users, because the added allowable deflection accommodates more time for the user to detect an impending failure; thus there is a better opportunity for corrective measures to be taken.

Figure 18:
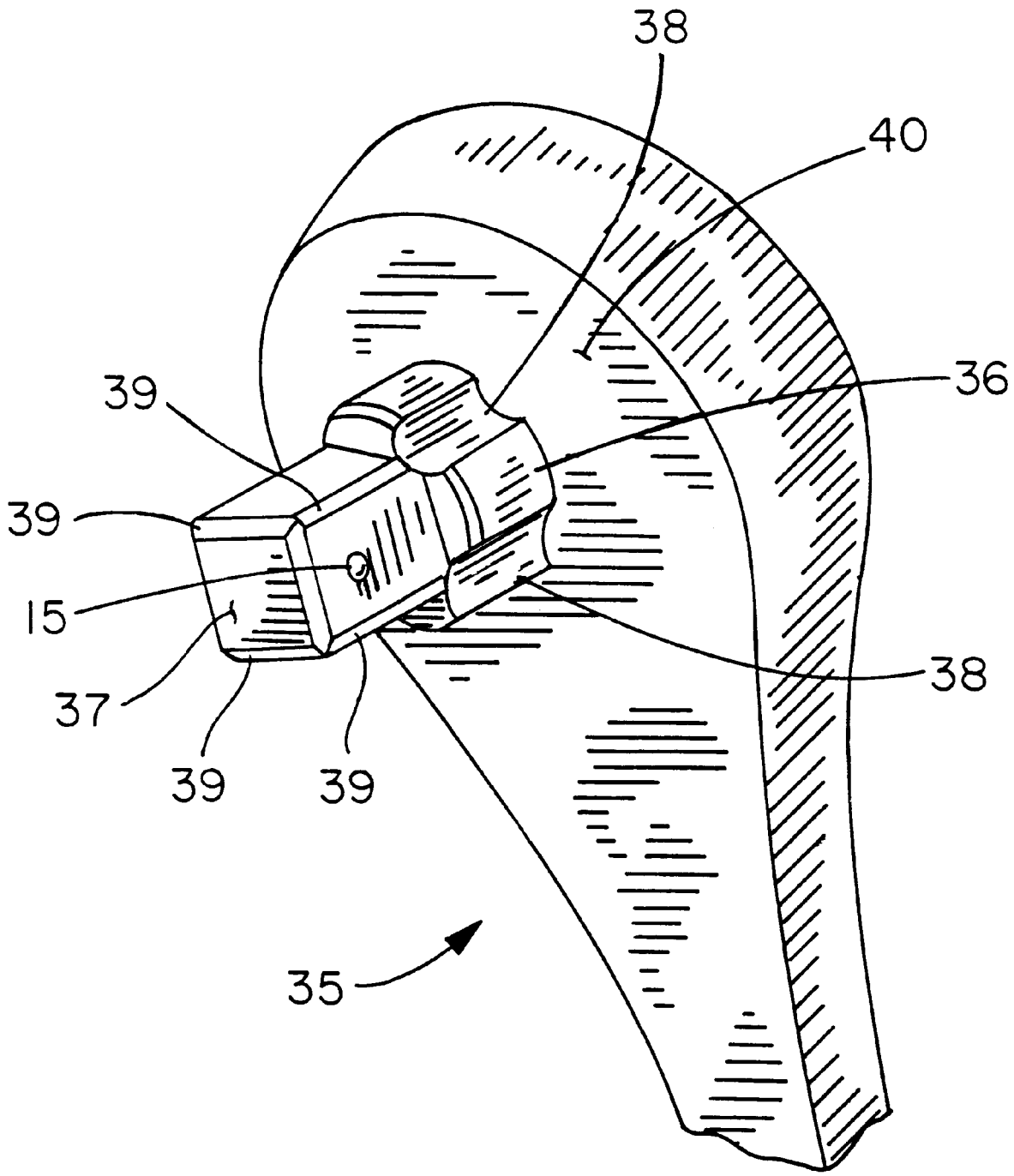
FIG. 18 illustrates a further embodiment of the present invention.

In FIG. 18, a conventional wrench 35 has been modified to reduce stresses by removing material from the integral annual collar 36 on the drive tang 37 to form respective scalloped recesses 38 at the longitudinal edges or "corners" 39 of the drive tang 37. These scalloped recesses 38 are circumferentially spaced with respect to each other, are aligned longitudinally with the corners 39 of the drive tang 37, and run from the drive tang 37 to the bottom surface 40 of the wrench 35.

Obviously, many modifications may be made without departing from the basic spirit of the present invention. For example, the improved socket 19 of the present invention (see FIG. 8) is a "deep" socket; however, the length of the improved socket 19 can be of any convenient dimension. Accordingly, it will be appreciated by those skilled in the art that within the scope of the appended claims, the invention may be practiced other than has been specifically described herein.

I claim:

1. In combination, a modified ratchet wrench and a modified wrench socket, wherein the modified ratchet wrench may be used with a conventional socket, and wherein the modified wrench socket may be used with a conventional ratchet, comprising a drive tang on the modified ratchet wrench, the drive tang having a first portion adjacent to the modified ratchet wrench and further having a second portion extending from the first portion to the end of the drive tang, at least one supplementary driving lug carried only by the first portion of the drive tang and extending radially therefrom, such that the supplementary driving lug does not extend the full length of the drive tang, the modified wrench socket having an opening receiving the drive tang and complementary thereto to effect torque transmission therebetween, the modified wrench socket having a top portion and further having at least one internal pocket extending axially from the top portion of the modified wrench socket and radially of the opening formed therein to receive the supplementary driving lug on the drive tang of the modified ratchet wrench; such that when the modified ratchet wrench is engaged with the modified wrench socket, the drive is through both the drive tang and the supplementary driving lug on the drive tang; thereby accommodating increased leverage on the modified ratchet wrench, preventing slippage between the modified ratchet wrench and the modified wrench socket, and precluding premature failure of the drive tang; and such that when the modified ratchet wrench is engaged with a conventional socket, the drive is only through the drive tang and the supplementary driving lug extends above the conventional socket; and such that when a conventional ratchet is engaged with the modified wrench socket, the drive is only through the drive tang of the conventional ratchet, and there is no engagement with the internal pocket in the modified wrench socket.

2. The combination of claim 1, wherein the drive tang on the modified ratchet wrench has a square cross-section cooperating with a complementary square cross-sectioned opening in the modified wrench socket; wherein the square cross-sectioned drive tang has four faces, each of which is provided with a supplementary driving lug, such that there are four supplementary driving lugs arranged at 90° to each other; and wherein the square cross-sectioned opening in the modified wrench socket has four pockets formed therein complementary to the four supplementary driving lugs on the drive tang of the modified ratchet wrench.

3. The combination of claim 2, further including a reinforcing collar between the modified ratchet wrench and the supplementary driving lugs on the drive tang.

4. The combination of claim 3, wherein the drive tang has longitudinal edges, and wherein scalloped recesses are formed between the supplementary driving lugs, the scalloped recesses being aligned with the longitudinal edges of the square cross-sectioned drive tang on the modified ratchet wrench.

* * * * *